US005745434A

United States Patent [19]

Cushman

[11] Patent Number: 5,745,434

[45] Date of Patent: Apr. 28, 1998

[54] ACOUSTIC ABSORPTION OR DAMPING MATERIAL WITH INTEGRAL VISCOUS DAMPING

[75] Inventor: William B. Cushman, Pensacola, Fla.

[73] Assignee: Poiesis Research, Inc., Pensacola, Fla.

[21] Appl. No.: 780,271

[22] Filed: Jan. 9, 1997

[51] Int. Cl.[6] ..... G10K 11/16

[52] U.S. Cl. ..... 367/1

[58] Field of Search ..... 367/1; 181/290, 181/294, 284

[56] References Cited

U.S. PATENT DOCUMENTS

| | | | |
|---|---|---|---|
| 5,272,284 | 12/1993 | Schmanski | 181/284 |
| 5,400,296 | 3/1995 | Cushman et al. | 367/1 |
| 5,526,324 | 6/1996 | Cushman | 367/1 |
| 5,536,910 | 7/1996 | Harrold et al. | 181/290 |

OTHER PUBLICATIONS

Hautmann & Jarzyuski "Ultrasonic hysteresis absorption in polymers" J. Appl. Phys, vol. 43, No. 11, Nov. 1972.

*Primary Examiner*—Daniel T. Pihulic

[57] ABSTRACT

Acoustic absorption or vibration damping materials are produced by mixing at least two species of particles into a restricted amount of matrix material in order to produce an acoustic absorption or vibration damping material with tortuous passageways throughout the material. The tortuous passageways of the instant invention serve to: a) reduce acoustic reflectivity at the surface, b) provide channels within which the interfacing medium such as air can interact viscously, c) increase the surface area between interfacing media and, d) improve structural stiffness by adding thickness without adding weight. Particle species within the matrix material are differentiated by their acoustic impedances. A particle species of particular interest is crumb tire rubber from used tires. This material is inexpensive and its use in this application has the societal advantage of making productive use of a material that is currently polluting the environment.

10 Claims, 2 Drawing Sheets

ACOUSTIC ABSORPTION OR DAMPING MATERIAL WITH INTEGRAL VISCOUS DAMPING

BACKGROUND OF THE INVENTION

1. Field of the Invention

This invention relates to acoustic absorption or damping materials with integral viscous damping that may be produced at low cost using reclaimed crumb tire rubber as a major ingredient.

2. Description of Related Art

Assuming a closed system, absorbing or damping unwanted acoustic or vibrational energy within a material involves converting that unwanted energy into another form, usually heat. Heat and acoustic or vibrational energy are closely related. At the molecular level the only distinction that may be made between heat energy and acoustic or vibrational energy is the vector direction of molecular displacements. Acoustic and vibrational energy is characterized by molecular displacements with vector directions that are highly correlated. Large numbers of molecules displace at the same time and in the same direction in this case. Heat in a particular medium may well have the same or more energy than propagating acoustic or vibrational energy, but the motion of the molecules is in random directions with the mean molecular displacement at any given location being near zero. To dissipate acoustic or vibrational energy as heat thus involves mechanisms that de-correlate molecular movements into random directions.

Several techniques are available for de-correlating molecular movements into random directions. For example, Cushman, et al. (U.S. Pat. No. 5,400,296) teach the use of two or more species of particles with differing characteristic acoustic impedances in a matrix material. Within the matrix material reflections at boundaries with higher impedance particles are in phase, and reflections at boundaries with lower impedance particles are out of phase. Reflections with different phase relationships within the same locale increase the probability of phase cancellations. Phase cancellations de-correlate molecular movements into random directions. A second approach to de-correlating molecular movements involves the careful choice of matrix materials that exhibit a high degree of internal hysteresis. Internal hysteresis is thought to be caused by metastable molecular energy levels within the material. Propagating acoustic or vibrational energy may boost a particular molecule into a higher energy level, thus subtracting that energy from propagating energy, where the molecule remains for some time before randomly returning to its original energy level. For a discussion of this effect see Hartmann and Jarzynski, "Ultrasonic hysteresis absorption in polymers," *J. Appl. Phys.*, Vol. 43, No. 11, November 1972, 4304–4312. A third method for redirecting the molecular movements of acoustic or vibrational energy is to convert this energy into electricity using the piezoelectric effect and to dissipate it as heat through resistive heating. Cushman, (U.S. Pat. No. 5,526,324) has made piezoelectrically active acoustic damping materials by embedding graphite within polyvinylidene fluoride (PVDF) and PVDF co-polymers. The β crystalline phase of PVDF is piezoactive. Graphite particles embedded in β crystaline PVDF or co-polymers thereof provide a path for local currents to flow and produce heat resistively.

In addition to the various techniques for increasing acoustic absorption or vibration damping within a material the shape of a material conducting acoustic or vibratory energy can be made to redirect acoustic energy in harmless directions (Cushman, Pending U.S. Ser. No. 08/626,053 "Panel spacer with acoustic and vibration damping") or to promote viscous damping within the interfacing medium, such as air. Matted glass wool panels are examples of structures that promote viscous damping within the interfacing medium.

Even though the above techniques are available and not mutually exclusive a plurality of the above noted acoustic principles are rarely applied simultaneously within the same material or blocking structure. The reasons are economic rather than physical. For example, where a large sheet of acoustic material may be required, economic considerations will usually dictate thin sections. However, when thin panel sections are attempted, the entire panel will simply follow Newton's well known relationship, F=ma. That is, the entire panel will move over in response to a pressure wave and act as a diaphragm on the opposite surface. In this case very little energy will enter the material where it may be dissipated. The only effective way to prevent movement of a thin section is to increase the mass of the panel or to design the structure to optimize stiffness of the panel against its support. Both stiffness and mass can be improved with good engineering, but the same stiffness or mass that helps to prevent passage of energy will also increase the reflectivity of the panel, often causing another difficulty. Office dividers illustrate this problem: it is desirable to both prevent acoustic energy from passing through and to prevent acoustic energy from reflecting from the divider. The only effective anti-reflective measures in current use are viscous damping layers of material with high porosity, such as matted glass fiber. The glass in these materials, however, is an excellent conductor of acoustic energy.

SUMMARY OF THE INVENTION

Accordingly, an object of the instant invention is to provide an improved and economical acoustic absorption or vibration damping material that uses the Cushman, et al. principle of multiple species particles within a matrix material, described in U.S. Pat. No. 5,400,296, in conjunction with a structural design that promotes stiffness in large panels, substantially increases the surface area of the interface between media, and promotes viscous damping internally and at the interface with the interfacing medium. A further object is to accomplish the first object of the instant invention while achieving the societal end of making productive use of materials (used tires) that are currently polluting the environment. Used tires numbering in the billions are currently occupying the landfills of industrialized nations.

These and additional objects of the invention may be accomplished by mixing reclaimed crumb tire rubber from used tires with a high acoustic impedance particle species such as iron or with a low acoustic impedance species such as ceramic microspheres, or with both, within a high internal hysteresis matrix material such as urethane resin. Only sufficient resin is used to coat or partially coat all the particle species. Restricting the amount of matrix material used creates a plurality of viscous damping passageways through which the interfacing medium such as air can interact viscously and within which a substantially greater surface area is present at the interface between media. Increasing the surface area at the interface between media aids in promoting energy transfer from one medium to the other. In one embodiment of the instant invention at least one side of a barrier made from the material of the instant invention contains no through passageways.

BRIEF DESCRIPTION OF THE DRAWINGS

In the following Description of the Preferred Embodiments and the accompanying drawings, like numerals in different figures represent the same structures or elements. The representation in each of the figures is diagrammatic and no attempt is made to indicate actual scales or precise ratios. Proportional relationships are shown as approximations.

DESCRIPTION OF THE PREFERRED EMBODIMENTS

The parts indicated on the drawings by numerals are identified below to aid in the reader's understanding of the present invention.

10. Crumb tire rubber particles.

20. Matrix material.

30. Viscous damping passageways.

40. High impedance particles.

50. Upper surface of panel.

60. Bottom surface of panel.

70. Low impedance particles.

80. Closed bottom surface of panel.

Figure 1:
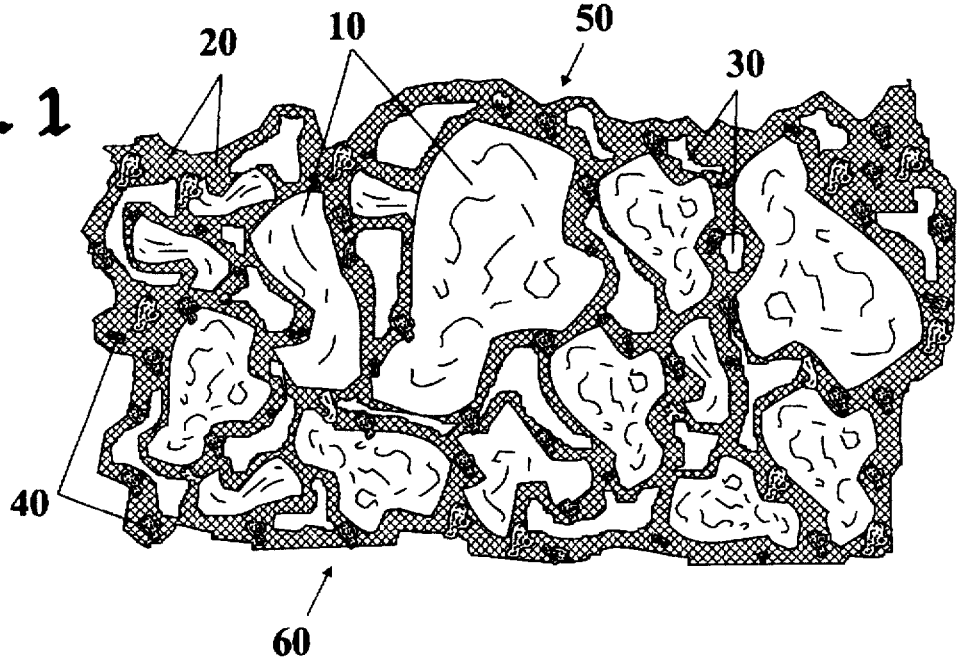
FIG. 1 shows a section of an embodiment of the instant invention with crumb tire rubber particles and high impedance particles in a matrix material with viscous damping passageways therein.

A section of a preferred embodiment of the instant invention is shown in FIG. 1 with crumb tire rubber particles 10 and high impedance particles 40 in a matrix material 20 with viscous damping passageways 30 therein. Viscous damping passageways within the section of an embodiment of the instant invention shown in FIG. 1 are contiguous with the upper surface 50 and the lower surface 60 of a panel made from the acoustic or damping material of the instant invention. The viscous damping passageways of the section of an embodiment of the instant invention of FIG. 1 serve to: a) reduce acoustic reflectivity at the surface, b) provide channels within which the interfacing medium such as air can interact viscously, c) increase the surface area between interfacing media and, d) improve structural stiffness by adding thickness without adding weight. A preferred high impedance particle species is iron. The section of an embodiment of the instant invention shown in FIG. 1 may be manufactured by mixing the particle species (preferably iron and reclaimed crumb tire rubber) using only enough matrix material (preferably urethane) to wet, or partially wet, all surfaces. Crumb tire rubber particle size must be large enough so that when all surfaces are wetted and the materials are mixed together viscous damping passageways are formed between particles. Alternatively, a blowing agent may be added to the mixture to assist in the formation of viscous damping passageways. After mixing, the resulting material may be spread on a suitable surface such as stainless steel or Teflon and allowed to cure or baked in an oven to promote a cure.

Figure 2:
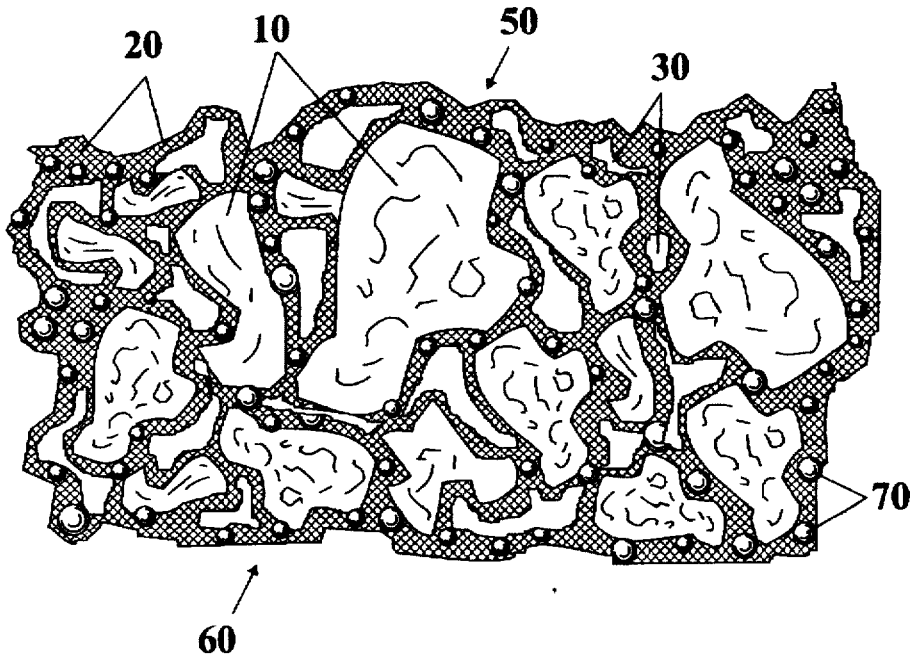
FIG. 2 shows a section of an embodiment of the instant invention with crumb tire rubber particles and low impedance particles in a matrix material with viscous damping passageways therein.

A section of a preferred embodiment of the instant invention is shown in FIG. 2 with crumb tire rubber particles 10 and low impedance particles 70 in a matrix material 20 with viscous damping passageways 30 therein. Tortuous passageways within the section of an embodiment of the instant invention shown in FIG. 2 are contiguous with the upper surface 50 and the lower surface 60 of a panel made from the acoustic or damping material of the instant invention. The viscous damping passageways of the section of an embodiment of the instant invention of FIG. 2 serve to: a) reduce acoustic reflectivity at the surface, b) provide channels within which the interfacing medium such as air can interact viscously, c) increase the surface area between interfacing media and, d) improve structural stiffness by adding thickness without adding weight. A preferred low impedance particle species is ceramic microspheres. The section of an embodiment of the instant invention shown in FIG. 2 may be manufactured by mixing the particle species (preferably ceramic microspheres and reclaimed crumb tire rubber) using only enough matrix material (preferably urethane) to wet, or partially wet, all surfaces. Crumb tire rubber particle size must be large enough so that when all surfaces are wetted and the materials are mixed together tortuous passages are formed between particles. Alternatively, a blowing agent may be added to the mixture to assist in the formation of. After mixing, the resulting material may be spread on a suitable surface such as stainless steel or Teflon and allowed to cure or baked in an oven to promote a cure.

Figure 3:
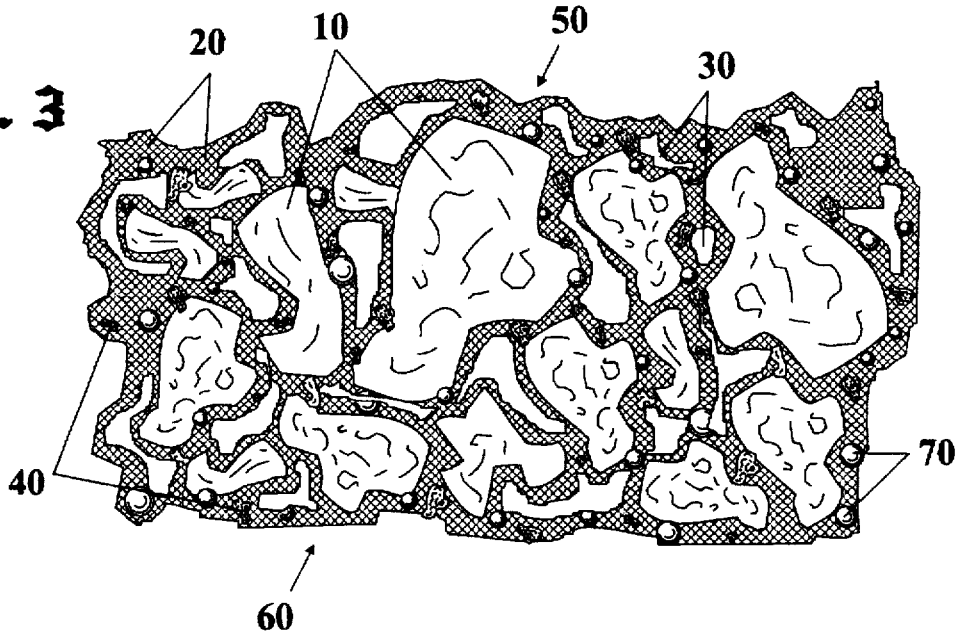
FIG. 3 shows a section of an embodiment of the instant invention with crumb tire rubber particles and high impedance particles and low impedance particles in a matrix material with viscous dampling passageways therein.

A section of a preferred embodiment of the instant invention is shown in FIG. 3 with crumb tire rubber particles 10, high impedance particles 40, and low impedance particles 70, in a matrix material 20 with viscous damping passageways 30 therein. Viscous damping passageways within the section of an embodiment of the instant invention shown in FIG. 3 are contiguous with the upper surface 50 and the lower surface 60 of a panel made from the acoustic or damping material of the instant invention. The viscous damping passageways of the section of an embodiment of the instant invention of FIG. 3 serve to: a) reduce acoustic reflectivity at the surface, b) provide channels within which the interfacing medium such as air can interact viscously, c) increase the surface area between interfacing media and, d) improve structural stiffness by adding thickness without adding weight. A preferred high impedance particle species is iron. A preferred low impedance particle species is ceramic microspheres. The section of an embodiment of the instant invention shown in FIG. 3 may be manufactured by mixing the particle species (preferably iron, reclaimed crumb tire rubber and ceramic microspheres) using only enough matrix material (preferably urethane) to wet, or partially wet, all surfaces. Crumb tire rubber particle size must be large enough so that when all surfaces are wetted and the materials are mixed together viscous damping passageways are formed between particles. Alternatively, a blowing agent may be added to the mixture to assist in the formation of viscous damping passageways. After mixing, the resulting material may be spread on a suitable surface such as stainless steel or Teflon and allowed to cure or baked in an oven to promote a cure.

Figure 4:
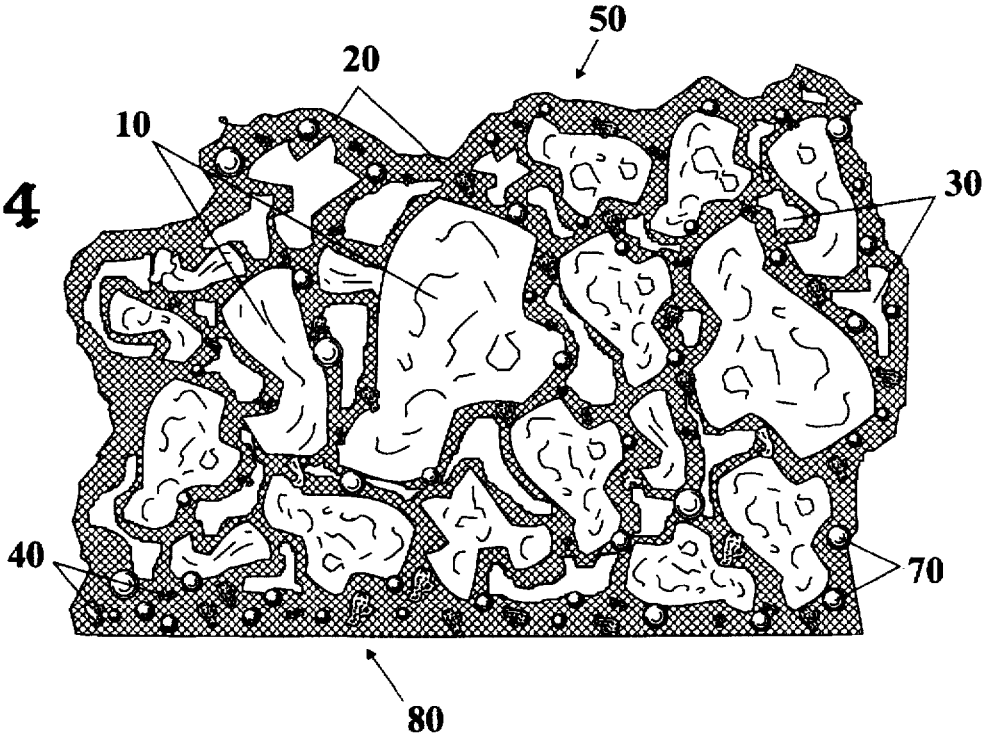
FIG. 4 shows a section of an embodiment of the instant invention with crumb tire rubber particles and high impedance particles and low impedance particles in a matrix material with viscous damping passageways therein that do not penetrate at least one side of a panel comprised of the material of the instant invention.

A section of a preferred embodiment of the instant invention is shown in FIG. 4 with crumb tire rubber particles 10, high impedance particles 40, and low impedance particles 70, in a matrix material 20 with viscous damping passageways 30 therein. Viscous damping passageways within the section of an embodiment of the instant invention shown in FIG. 4 are contiguous with the upper surface 50 but not with the lower surface 80 of a panel made from the acoustic or damping material of the instant invention. The lower surface 80 of the section of an embodiment of the instant invention in FIG. 4 serves as a final barrier to acoustic energy within the interfacing medium entering through the upper surface 50. Reflections from lower surface 80 must pass back through the viscous damping passageways of the instant invention before being returned to the propagating medium, thus providing many opportunities for phase cancellation and viscous damping along the way. The viscous passageways of the embodiment of the instant invention of FIG. 4 serve to: a) reduce acoustic reflectivity at the surface, b) provide channels within which the interfacing medium such as air can interact viscously, c) increase the surface area between interfacing media and, d) improve structural stiffness by adding thickness without adding weight. A preferred high impedance particle species is iron. A preferred low impedance particle species is ceramic microspheres. The section of an embodiment of the instant invention shown in FIG. 4 may be manufactured by mixing the particle species (preferably iron, reclaimed crumb tire rubber and ceramic microspheres) using only slightly more than enough matrix material (preferably urethane) to wet all surfaces. Crumb tire rubber particle size must be large enough so that when all surfaces are wetted and the materials are mixed together tortuous passages are formed between particles. Alternatively, a blowing agent may be added to the mixture to assist in the formation of viscous damping passageways. In the section of an embodiment of the instant invention shown in FIG. 4, sufficient matrix material and high and low impedance particles should be present to drain to the lower surface and seal it. Or, a second mix of matrix material and high and low impedance particles can be spread on the curing surface prior to spreading the mix of matrix material, crumb tire rubber and high and/or low impedance particles produced as described above. After spreading on a suitable surface such as stainless steel or Teflon the material may be allowed to cure or baked in an oven to promote a cure.

Many modifications and variations of the present invention are possible in light of the above teachings. For example, a wide variety of matrix materials may be used, including polyester, epoxy and vinyl ester thermoset materials as well as numerous thermoplastic materials. A wide variety of high and low impedance particle species may be used, (brass, lead, bismuth, glass microspheres, plastic microspheres) and although reclaim crumb tire rubber is an excellent material for this application many other materials could be substituted to achieve specific ends, for example cork crumb or sawdust. With specific applications it may be advisable to add deodorant and/or flame retardant as well. It is therefore to be understood that, within the scope of the appended claims, the instant invention may be practiced otherwise than as specifically described.

I claim:

1. An acoustic attenuation or vibration damping material comprised of a matrix material with a plurality of viscous damping passageways penetrating throughout said matrix material, and with at least two species of particles incorporated within said matrix material, said particles being species differentiated by their characteristic acoustic impedances.

2. The acoustic absorption or vibration damping material of claim 1 where said matrix material is urethane.

3. The acoustic absorption or vibration damping material of claim 1 where one of said species of particles incorporated within said matrix material is reclaimed crumb tire rubber.

4. The acoustic absorption or vibration damping material of claim 1 where one of said species of particles incorporated within said matrix material is iron.

5. The acoustic absorption or vibration damping material of claim 1 where one of said species of particles incorporated within said matrix material is ceramics microspheres.

6. An acoustic attenuation or vibration damping material comprised of a matrix material with a plurality of viscous damping passageways penetrating throughout said matrix material but not through at least one side of said acoustic attenuation or vibration damping material, and with at least two species of particles incorporated within said matrix material, said particles being species differentiated by their characteristic acoustic impedances.

7. The acoustic absorption or vibration damping material of claim 6 where said matrix material is urethane.

8. The acoustic absorption or vibration damping material of claim 6 where one of said species of particles incorporated within said matrix material is reclaimed crumb tire rubber.

9. The acoustic absorption or vibration damping material of claim 6 where one of said species of particles incorporated within said matrix material is iron.

10. The acoustic absorption or vibration damping material of claim 6 where one of said species of particles incorporated within said matrix material is ceramic microspheres.

* * * * *